US009522408B2

(12) United States Patent
Hogan et al.

(10) Patent No.: US 9,522,408 B2
(45) Date of Patent: Dec. 20, 2016

(54) EDGER BLASTER

(71) Applicants: Robert S Hogan, Dunedin, FL (US); Brian Christopher, Panama City Beach, FL (US)

(72) Inventors: Robert S Hogan, Dunedin, FL (US); Brian Christopher, Panama City Beach, FL (US)

( * ) Notice: Subject to any disclaimer, the term of this patent is extended or adjusted under 35 U.S.C. 154(b) by 50 days.

(21) Appl. No.: 14/248,424

(22) Filed: Apr. 9, 2014

(65) Prior Publication Data

US 2014/0209711 A1 Jul. 31, 2014

Related U.S. Application Data

(63) Continuation-in-part of application No. 12/687,922, filed on Jan. 15, 2010, now Pat. No. 8,727,245.

(51) Int. Cl.
*B05B 15/06* (2006.01)
*B05B 15/04* (2006.01)

(52) U.S. Cl.
CPC ..... *B05B 15/061* (2013.01); *B05B 15/0437* (2013.01)

(58) Field of Classification Search
CPC ..... A62C 31/24; B05B 15/06; B05B 3/18; B05B 3/00; B05B 15/0437; B05B 15/061
USPC . 239/750, 280, 282, 532, 754, 722; D32/15; D15/17
See application file for complete search history.

(56) References Cited

U.S. PATENT DOCUMENTS

| | | | | |
|---|---|---|---|---|
| 1,949,904 | A * | 3/1934 | Guedel | 239/280 |
| 4,349,039 | A * | 9/1982 | Egger | 134/167 C |
| 4,877,348 | A * | 10/1989 | Opie | 404/93 |
| 5,351,762 | A * | 10/1994 | Bean | 172/17 |
| 5,669,558 | A * | 9/1997 | Ichel | 239/311 |
| 6,776,363 | B1 * | 8/2004 | Falletta et al. | 239/722 |
| 2008/0217878 | A1 * | 9/2008 | Cephas | 280/47.35 |

* cited by examiner

*Primary Examiner* — Arthur O Hall
*Assistant Examiner* — Chee-Chong Lee
(74) *Attorney, Agent, or Firm* — Defillo & Associates, Inc.; Evelyn A Defillo

(57) ABSTRACT

The present invention relates to an edger adapted to be used with a spray wand to clean an edge of a hard surface in contact with a lawn. The edger includes a single piece plate that extends vertically from the hard surface. The single piece plate having a short side forming a first angle with a large side, a first hole formed at the larger side, a wheel secured to the plate, a second hole formed on the short side, and a coupler. The spray wand is adapted to be connected to the second end of the coupler. In a working position, the single piece plate engages the vertical side of the edge and slides through a channel formed between the lawn and the vertical side of the edge as the wheel rolls on top of the hard surface.

1 Claim, 7 Drawing Sheets

EDGER BLASTER

RELATED U.S. APPLICATION

This application is a continuation-in-part of U.S. application Ser. No. 12/687,922 filed Jan. 15, 2010, entitled PRESSURE WASHER WAND EDGER, allowed, the disclosure of which is incorporated herein by reference.

FIELD OF THE INVENTION

The present invention relates to an attachment for a spray wand, particularly to an attachment which can be used for cleaning the edges of a sidewalk, driveway, or other hard surface.

BACKGROUND OF THE INVENTION

Pressure washer devices have been used for many years. However, the pressure washer devices currently available are difficult to use while cleaning the edges of hard surfaces.

One of the most popular pressure washer tools known in the art is called SURFACE CLEANER®. A SURFACE CLEANER® looks like a lawn mower but with no engine on the top. The device has a bar underneath of the housing. The bar is mounted to the SURFACE CLEANER® at the center of the bar, this is where the high water pressure enters the bar causing the bar to spin very fast. There is a water jet at each end of the bar. This design enables the machine to clean hard surfaces much faster than a spray wand. The most common size SURFACE CLEANER® is 20 inches wide but it only cleans a path of about 18 inches wide.

Unfortunately, the SURFACE CLEANER® device has a disadvantage. When cleaning the hard surface, the surface cleaner does not clean all the way up to the edge of the hard surface because the surface cleaner is riding along the edge of the grass leaving an unclean strip of an inch or more wide.

The user in the pressure washing industry commonly cleans this leftover dirty strip with a spray wand. Spray wands are held freehand while cleaning the edges, which makes the cleaning process a slow, tedious task due to the high water pressure coming off the edge of the hard surface hitting the adjacent dirt and grass, creating a muddy mess or even flooding. In addition, the operator is cleaning the edges and walking at the same time, which can cause the operator to veer off the edge and hit the grass or dirt adjacent to the edge creating a greater muddy mess or even flooding. Furthermore, hitting the grass and dirt adjacent to the edge creates grooves on the lawn, damaging the lawn and creating an unpleasant view.

An attachment for a pressure washer wand edger adapted to be used with a spray wand to clean an edge of a hard surface in contact with a lawn was previously developed by a common inventor. Unfortunately, this previous edger was difficult to manipulate during the connection and disconnection of the edger to the wand. In addition, this previous edger was difficult to handle by a normal homeowner, since the device was bulky and heavy. Finally, the previous edger has a very complicated mechanical design, which results in a high manufacturing cost.

Accordingly, it is desirable to provide an edger capable of easily and swiftly cleaning the edges along sidewalks, driveways, or any other hard surface without virtually any muddy mess or flooding. In addition, it is desirable to provide an edger that prevents high pressure water from hitting the lawn or landscape adjacent to the edge of the surface to be cleaned. Finally, it is desirable to provide an edger that is easy to connect and disconnect to the wand, is lightweight, and has a low manufacture cost.

SUMMARY OF THE INVENTION

The present invention includes an edger adapted to be used with a spray wand to clean an edge of a hard surface in contact with a lawn, the edge having a vertical side in contact with the lawn and a top side forming a right angle with the vertical side, the edger includes a single piece plate adapted to be extended vertically from the hard surface, the single piece plate having a short side forming a first angle with a large side, a front end, a rear end, a first side, and a second side; a first hole formed at the larger side and near the front end of the single piece plate; an axle pin extended through the first hole; a wheel mounted on the axle pin, the wheel projecting perpendicularly from the first side of the single piece plate; a second hole formed on the short side and near the rear end of the single piece plate; a coupler having a first end extending through a first side of the second hole and a second end extending through a second side of the second hole; the spray wand is adapted to be connected to the second end of the coupler; a fluid is configured to be dispensed from the spray wand and sprayed through the first end of the coupler at a second angle toward the top side of the edge of the hard surface; in a working position, the single piece plate engages the vertical side of the edge and slides through a channel formed between the lawn and the vertical side of the edge as the wheel rolls on top of the hard surface.

In addition, the present invention relates to a combination of a spray wand and an edger to clean an edge of a hard surface in contact with a lawn, the edge having a vertical side in contact with the lawn and a top side forming a right angle with the vertical side, the combination of the spray wand and the pressure washer wand edger includes a single piece plate adapted to be extended vertically from the hard surface, the single piece plate having a short side forming a first angle with a large side, a front end, a rear end, a first side, and a second side; a first hole formed at the larger side and near the front end of the single piece plate; an axle pin extended through the first hole; a wheel mounted on the axle pin, the wheel projecting perpendicularly from the first side of the single piece plate; a second hole formed on the short side and near the rear end of the single piece plate; a coupler having a first end extending through a first side of the second hole and a second end extending through a second side of the second hole;

the spray wand connected to the second end of the coupler; a fluid is dispensed from the spray wand and sprayed through the first end of the coupler at a second angle toward the top side of the edge of the hard surface; in a working position, the single piece plate engages the vertical side of the edge and slides through a channel formed between the lawn and the vertical side of the edge as the wheel rolls on top of the hard surface.

The foregoing has outlined some of the more pertinent objectives of the present invention. These objectives should be construed to be merely illustrative of some of the more pertinent features and applications of the invention. Many other beneficial results can be obtained by applying the disclosed invention in a different manner or modifying the invention within the scope of the disclosure. Accordingly, other objectives and a fuller understanding of the invention may be had by referring to the summary of the invention and the detailed description describing the preferred embodiment, in addition to the scope of the invention defined by the claims taken in conjunction with the accompanying drawings.

BRIEF DESCRIPTION OF THE FIGURES

For a fuller understanding of the nature and objectives of the invention, reference should be made to the following detailed description, taken in connection with the accompanying drawings, in which.

DETAILED DESCRIPTION OF THE INVENTION

For purposes of this application, the term "hard surface" will be used to refer to any type of pavement, driveway, floor, deck, sidewalk, or any other surface having edges. The edger of the present invention may be used in any application where the edges of the hard surface need to be cleaned.

The edger according to the present invention provides a way to clean the edges (a few inches wide) of hard surfaces without virtually any muddy-flooded mess or damage to the adjacent landscaping. In addition, the present invention prevents flooding by allowing the user to move faster during the cleaning process; thus, less water is accumulated in the landscaping close to the edges of the hard surface. Furthermore, the device of the present invention cleans the edges 5 to 10 times faster than the spray wand of the prior art, it is easy to handle, it is connected and disconnected from the wand, and has a lower cost than prior devices.

Figure 1:
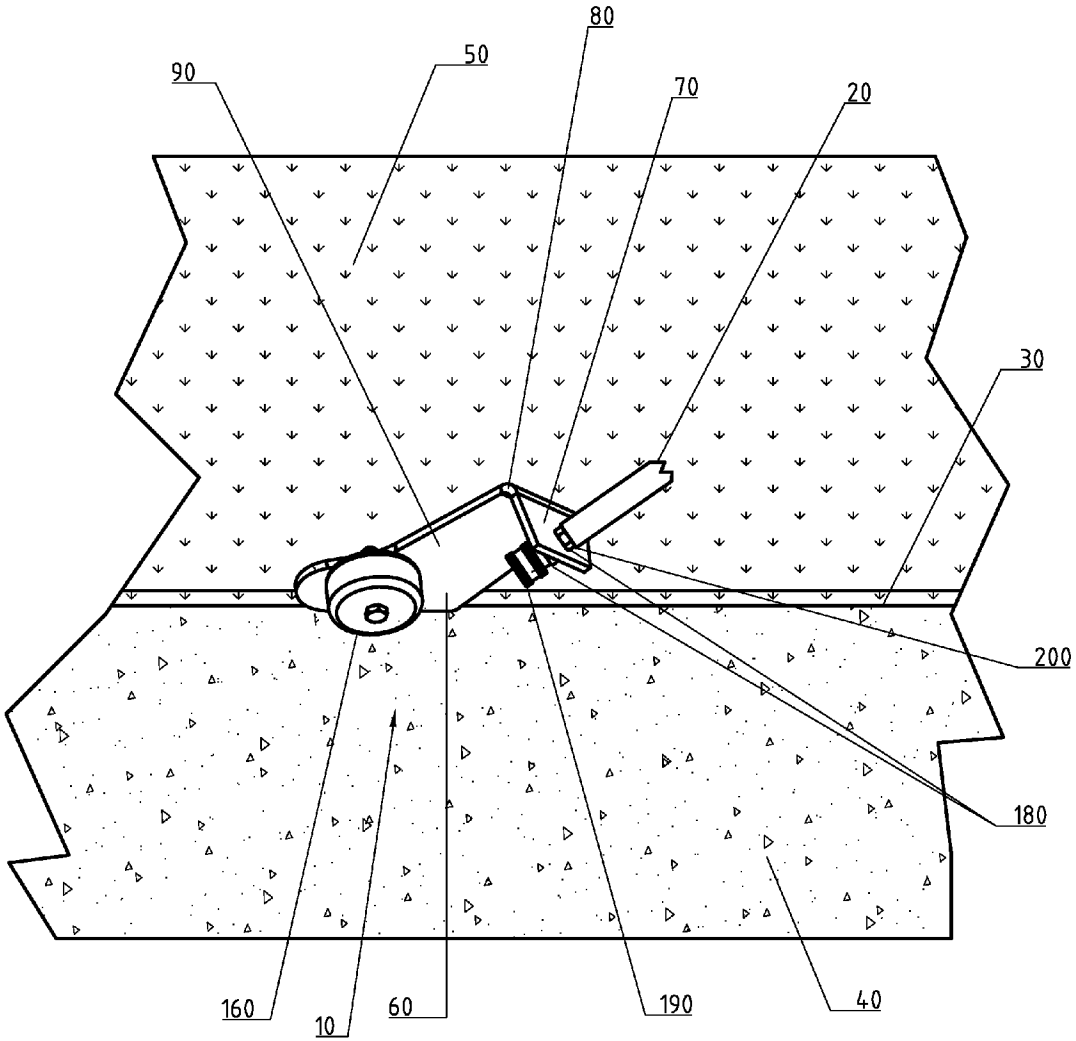
FIG. 1 illustrates a perspective front view of an edger according to the embodiment of the present invention showing the edger in a working position.
Figure 2:
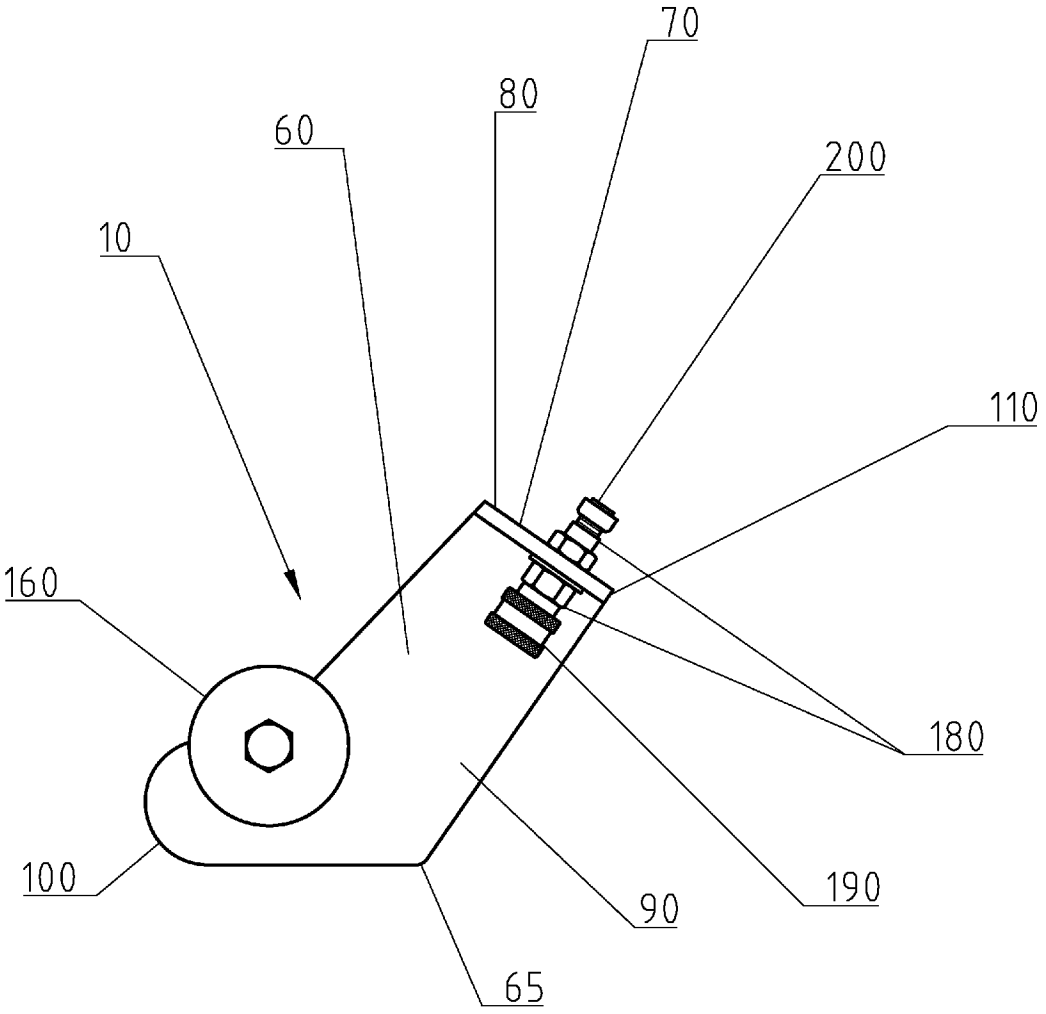
FIG. 2 illustrates a perspective right side view of the edger of FIG. 1.
Figure 3:
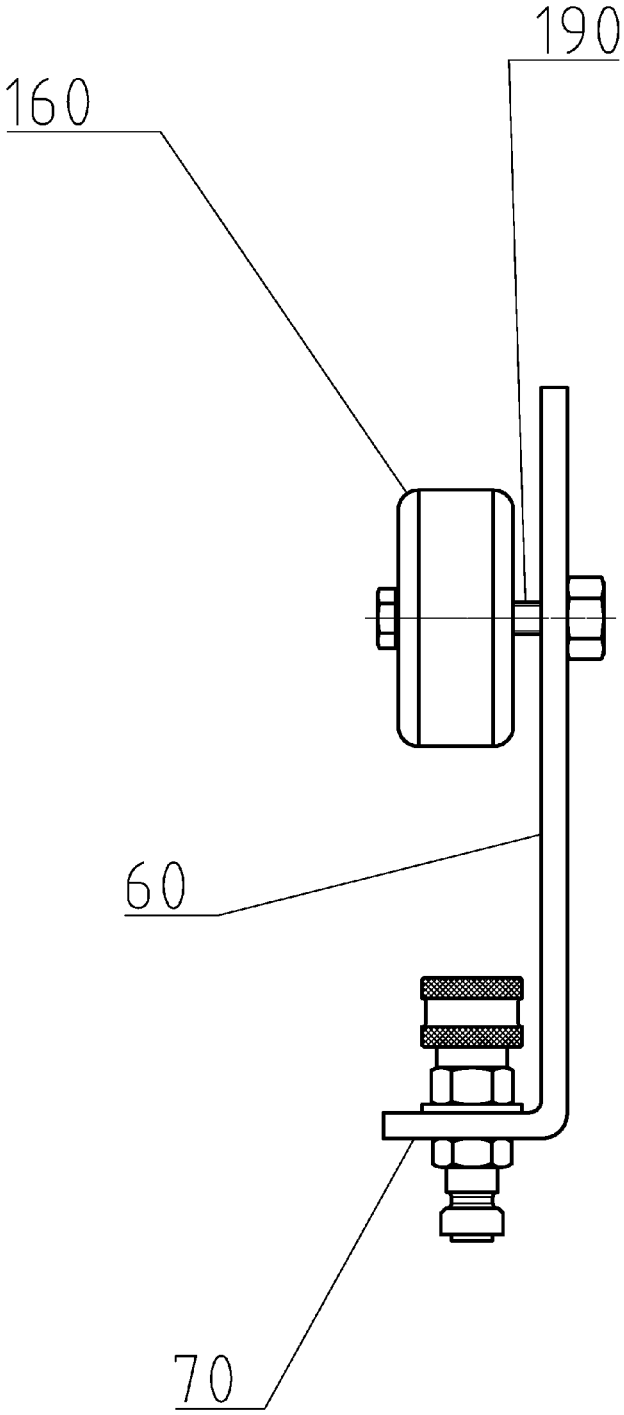
FIG. 3 illustrates a perspective top view of the edger of FIG. 1.
Figure 4:
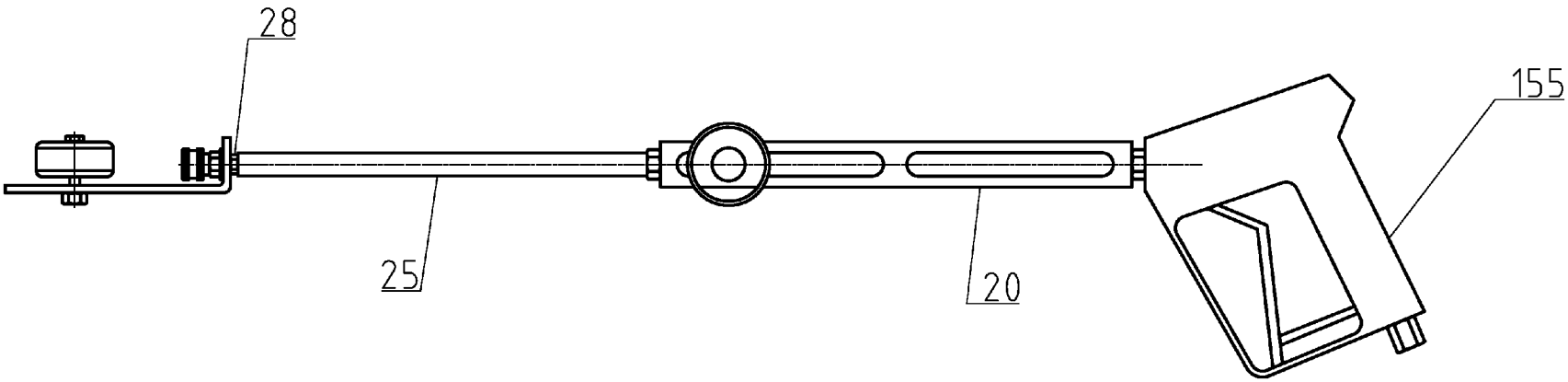
FIG. 4 illustrates a perspective side view of the edger according to the present invention having a wand attached to the edger.
Figure 5:
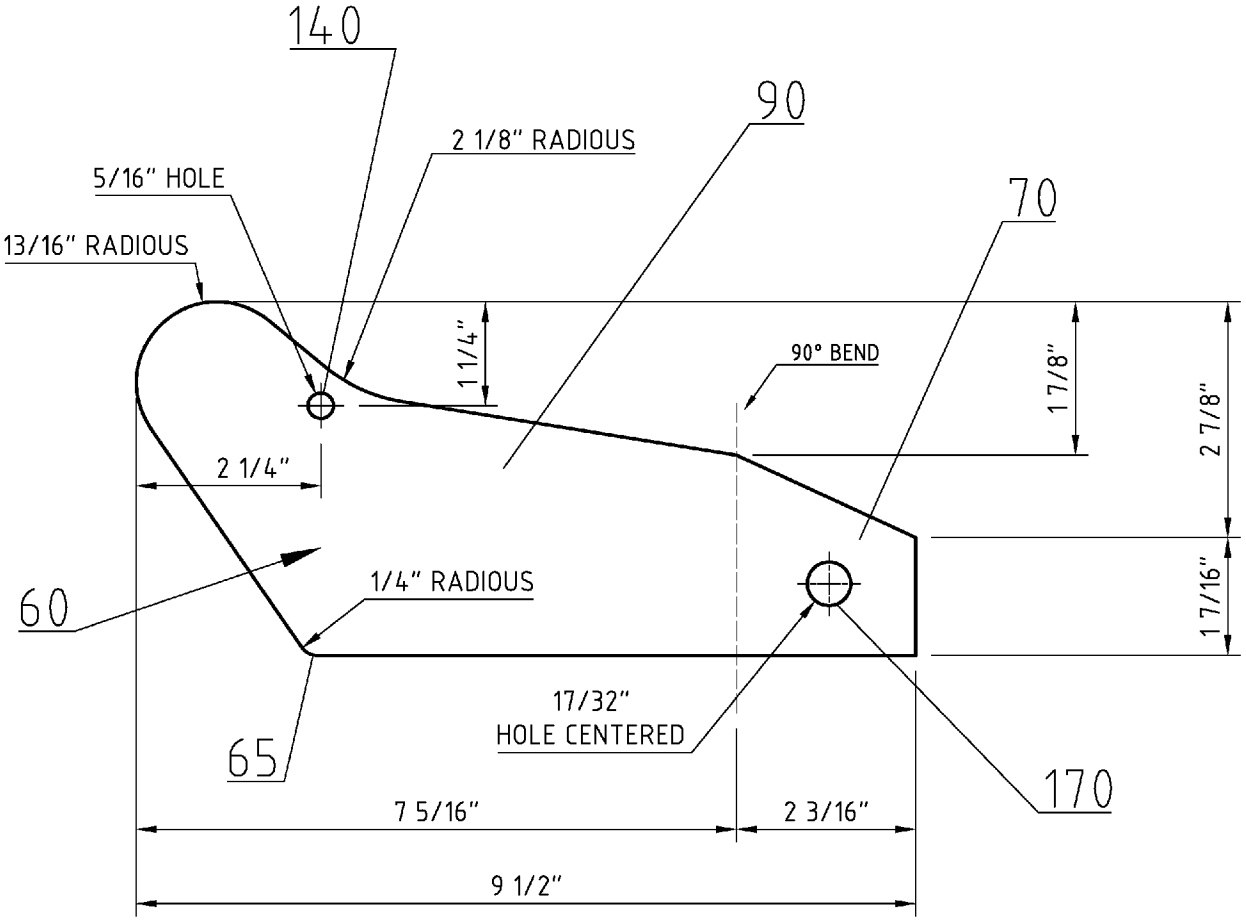
FIG. 5 illustrates a side view of a plate for the edger of FIG. 1.
Figure 6:
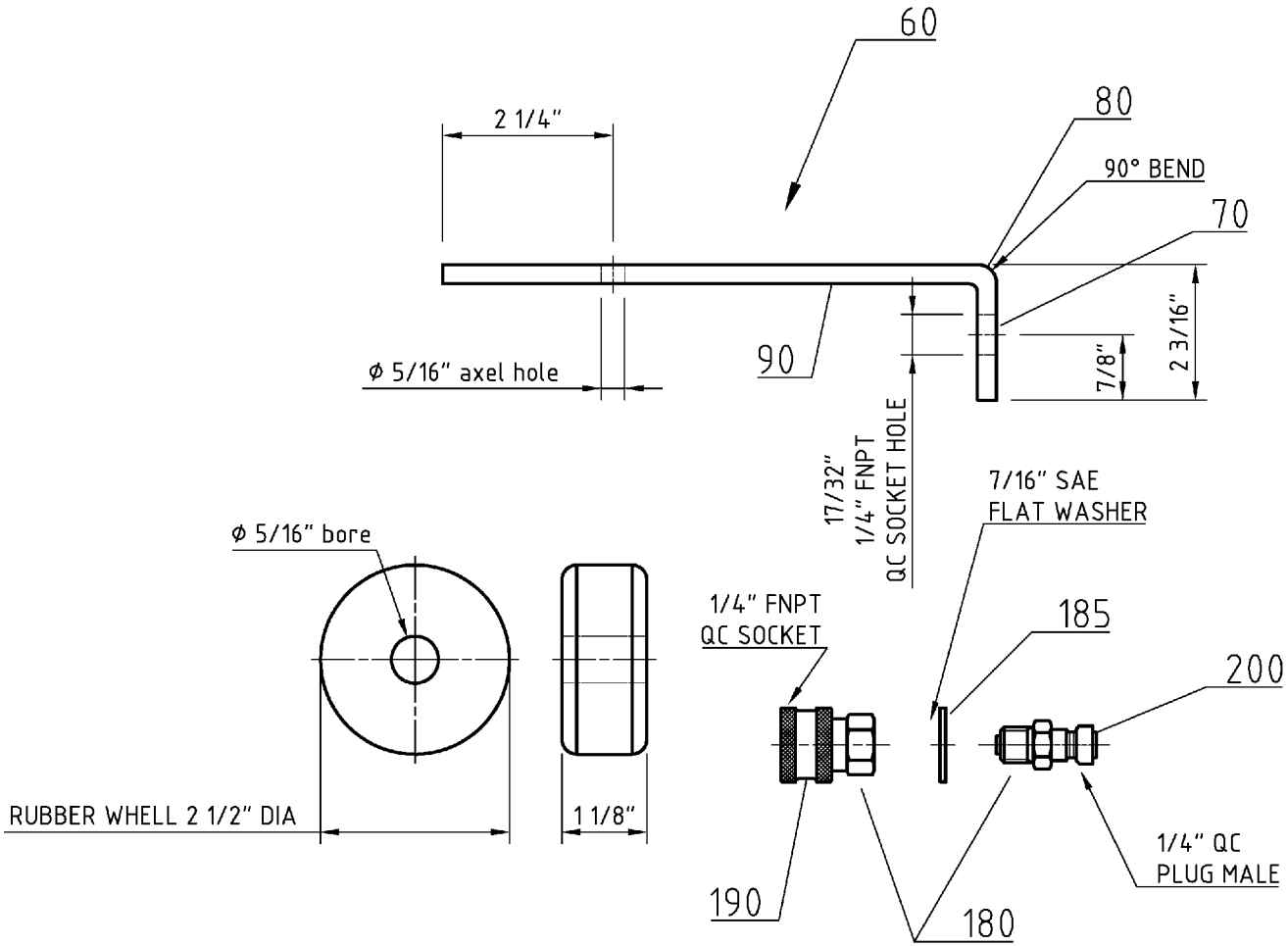
FIG. 6 illustrates a detailed view of the components of the edger of FIG. 1.
Figure 7:
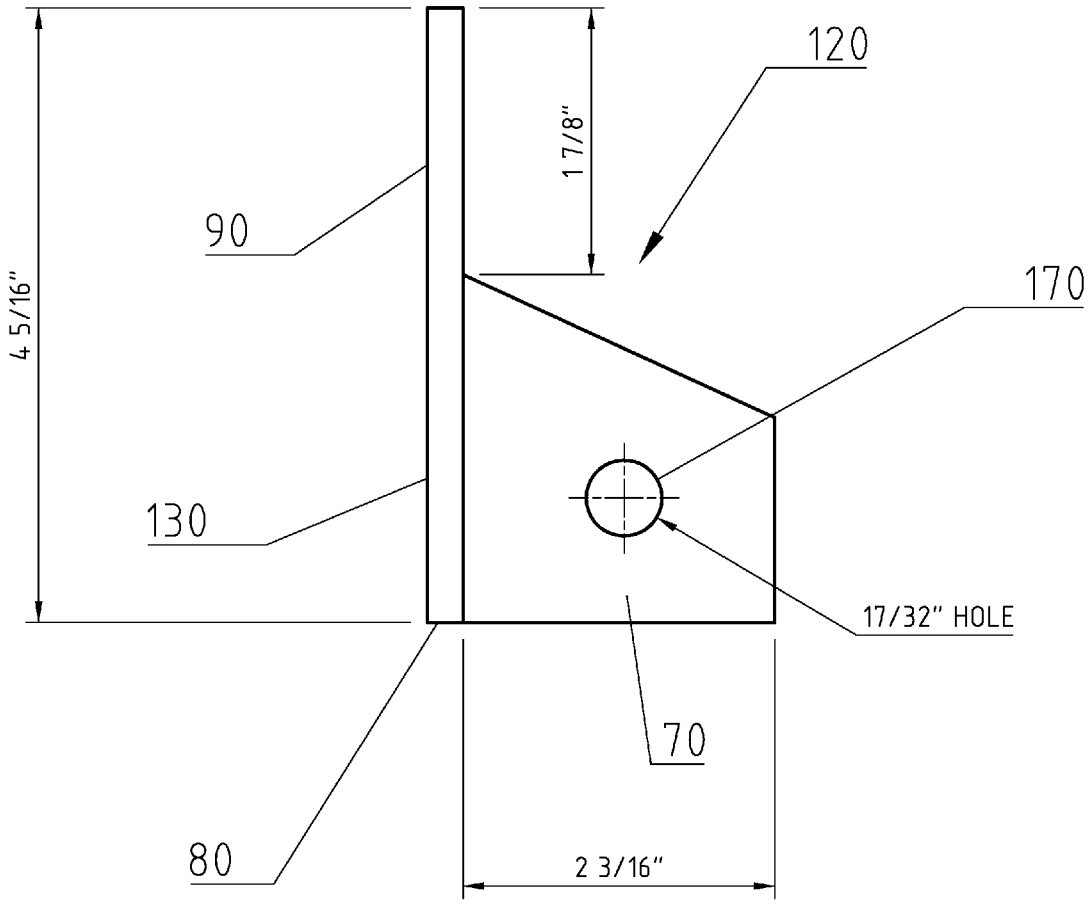
FIG. 7 illustrates a front view of the plate for the edger of FIG. 1.

FIGS. 1-4 illustrate an edger 10 according to the embodiment of the present invention. The edger 10 adapted to be used with a spray wand 20 (FIG. 4) to clean an edge 30 of a hard surface 40 in contact with a lawn 50. The edge 30 having a vertical side in contact with the lawn 50 and a top side forming a right angle with the vertical side.

The edger includes a single piece plate 60 adapted to be extended vertically from the hard surface 40. The single piece plate 60 having a short side 70 forming a first angle 80 with a large side 90, a front end 100, a rear end 110, a first side 120, and a second side 130.

A first hole 140 is formed at the large side 90 and near the front end 100 of the single piece plate 60. The first hole 140 may have approximately ¼ to about ⅜ inches in diameter. In some embodiments, the first hole 140 may have a 5/16 inch diameter.

An axle pin 150 extends through the first hole 140. A wheel 160 is mounted on the axle pin 150, the wheel 160 projects perpendicularly from the first side 120 of the single piece plate 60.

A second hole 170 is formed on the short side 70 and near the rear end 110 of the single piece plate 60. The second hole 170 may have approximately 7/16 to about ⅝ inches in diameter. In some embodiments, the second hole 170 may have a 17/32 inch diameter.

A coupler 180 having a first end 190 extending through a first side of the second hole 170 and a second end 200 extending through a second side of the second hole 170. The coupler 180 may be a quick coupler. The coupler 180 may be, for example, a female and male coupler. The female and male coupler may have a ¼ inch thread.

The coupler 180 may be placed at an angle, thus the first end 190 of the coupler is parallel to the large side 90 of the one piece plate 60. The angle may be, for example, a 45 degree angle.

In a preferred embodiment, the spray nozzle 28 of the present invention is a coupler having a fixed 40 degree spray angle, which allows a better cleaning for a 2 to 3 inch wide strip from the edge of the hard surface inwards.

A washer 185 may be operatively connected between the two ends 190, 200 of the coupler 180 and the second hole 170 on the short side 70 of the one piece plate 60.

The spray wand 20 is adapted to be connected to the second end 200 of the coupler 180. A fluid (not shown) is configured to be dispensed from the spray wand 20 and sprayed through the first end 190 of the coupler at a second angle toward the top side of the edge of the hard surface 40.

In a working position, the single piece plate 60 engages the vertical side of the edge 30 and slides through a channel C formed between the lawn 50 and the vertical side of the edge 30 as the wheel 160 rolls on top of the hard surface 40.

The single piece plate 60 protrudes below a surface of the wheel 160 at approximately 0.125 to 3 inches, or about ¼ of an inch, or about ⅛ of an inch lower than the bottom of the wheel 160. The wheel 160 supports the edger 10 a sufficient distance above the hard surface 40 and enables the edger 10 to be rolled along the edge 30 of the hard surface 40 in a straight path in cooperation with the plate 60. This allows the operator to maintain precise control of the pressure washer wand edger when the edger is in use.

The mechanical design of the present invention allows the single piece plate 60 to function as a guide to limit both the width and height of the spray created by the spray nozzle, while at the same time physically shields the high-pressure water spray from hitting the dirt and grass adjacent to the edge 30 of the hard surface 40. In this way, the edges are cleaned quickly, easily, and consistently as the single piece plate 60 directs the water spray directly to the edges 30 of the hard surface 40.

The single piece plate 60 serves as a platform to mount the wheel 160 and the coupler 180. The single piece plate 60 may be of a sturdy material, for example, metal, hard plastic, epoxy, alloys, or composite material. In some embodiments, the single piece plate 60 may be made of light weight aluminum, for example, a 0.125 thickness MF sheet aluminum 5052H32 sold by American Metals.

The single piece plate 60 may have any shape, such as square, rectangular, circular, triangular, etc. in a preferred embodiment; the single piece plate 60 has a short side 70 forming a first angle 80 with a large side 90. The angle 80 allows the single piece plate 60 to smoothly slide through the channel C at the same time that allows the operator to maintain precise control of the pressure washer wand edger when the edger is in use.

The short side 70 of the single piece plate 60 may have a width from about 2½ inches to about 4 inches, or from about 2½ to about 3, or from about 3 to about 4 inches.

The large side 90 of the single piece plate 60 may have a width from about 4¼ to about 7 inches, or from about 6 to about 4¼ inches, or from about 4¼ to 6 inches. The large side 90 may have a length from about 7½ to about 12 inches, or from about 7/12 to about 9 inches, or from about 9 to 12 inches.

The large side 90 may include a bend 65. The bend 65 may be from about 30 to about 60 degrees bend. In some embodiments, the bend 65 may be a 45 degree bend.

The wheel 160 is mounted to the single piece plate 60 for rolling the edger 10 along the edges 30 of the hard surface 40. The wheel 160 may be supported on axle pin 150 which extends through hole 140 formed in the large side 90 of the single piece plate 60. Any fastening means, such as nuts and washers or other type of connector secures the wheel 160 to the single piece plate 60. In a preferable embodiment, the wheels may have, but are not limited to, 2½ inches in diameter.

The diameter of the axle pin 150 may depend on the size of the wheel 160. The axle pin 150 may be, for example, a 5/16 of an inch diameter and a length of 2¼ inches.

In some embodiments, the axle pin 150 may be formed by a stud integrally formed with the single piece plate 60 and projecting therefrom.

The spray wand 20 comprises an elongated hollow rod 25 having a spray nozzle 28 in one of its ends. The spray wand 20 is attached to the edger 10 by means of a coupler 180 that joins the hollow rod 25 to the second end 200 of the coupler 180 holding the spray nozzle 28 fixed in place.

In a preferred embodiment, the hollow rod 25 may have a bend. In another preferred embodiment, the bend is approximately, but is not limited to, a 35 degree bend. The present invention is not limited to a bend of 35 degrees. A person skilled in the art would be able to choose the suitable angle for the bend.

The standard hollow rod known by the prior art is usually 36 inches long. The hollow rod 25 of the present invention is approximately 40-52 inches long, preferably 44-48 inches long. This allows the user to ease the posture and have better control of the edger 10.

The spray wand 20 further comprises a trigger gun 155. Any type of trigger gun known in the art may be used. In one embodiment, the present invention uses a trigger gun having specifications of 10.4 GPM, 5000 PSI, ⅜" MNPT inlet, ¼" outlet, and 300 degree F. maximum temperature.

The spray nozzle 28 is used to release the pressurized water from the pressure washer machine. The spray nozzle 28 is adjustable, so the water can be released at different pressures and spray volumes.

The edger 10 of the present invention is operatively connected to any commercial or most residential pressure washer wands known in the art. The known pressure washer transfers power to the edger 10 of the present invention.

In one embodiment of the present invention the spray wand of a conventional pressure washer is directly connected to the edger 10 of the present invention.

In another embodiment, the present invention provides a combination of a spray wand of a conventional pressure washer and the edger 10 of the present invention.

The edger 10 of the present invention is lightweight, yet very sturdy, to withstand the demands of repeated use. It is quickly and conveniently attached or detached from most residential or any commercial pressure washer wands known in the art.

The design of the edger of the present invention allows for cleaning a narrow area (only a few inches wide) from the edge of the hard surface inwards. The wand edger of the present invention is not designed to clean the entire area of the sidewalks, driveways, etc. because the single piece plate 60 needs to be in contact with the edges of the hard surface, which prevents the device from moving away from the edges.

It is apparent, in view of the teachings herein, that embodiments of the present invention are particularly useful for pressure washing the edges of a hard surface. It will be understood that embodiments of the invention can be useful for the application of any suitable fluid, whether water, paint, etc, that is sprayed onto the edges of a hard surface.

While the invention has been illustrated and described as embodiments of an edger, accordingly it is not limited to the details shown, since it will be understood that various omissions, modifications, substitutions and changes in the forms and details of the device illustrated and its operation can be made by those skilled in the art without departing in any way from the spirit of the present invention. The teachings of all of the references cited herein are incorporated by reference to the extent not inconsistent with the teachings herein.

What is claimed is:

1. An edger consisting of:

a single piece plate including:

a large plate having a front end, a rear end, a first side, and a second side;

a short plate protruding perpendicularly from the rear end of the large plate;

a first hole located on the large plate at the front end of the large plate;

an axle pin extended through the first hole;

a wheel mounted on the axle pin, the axle pin projecting perpendicularly from the first side of the large plate, the large plate protrudes below a bottom surface of the wheel;

a bend located at the rear end of the large plate and opposite to the first hole;

a second hole formed on the short plate; and a coupler having a first end extending through a first side of the second hole and a second end extending through a second side of the second hole, the coupler is placed at an angle, thus the first end of the coupler is parallel to the large plate.

* * * * *